United States Patent [19]

Akkerman

[11] 4,406,256

[45] Sep. 27, 1983

[54] AUTOMATIC COMPRESSION ADJUSTING MECHANISM FOR INTERNAL COMBUSTION ENGINES

[75] Inventor: James W. Akkerman, Houston, Tex.

[73] Assignee: The United States of America as represented by the Administrator of the National Aeronautics and Space Administration, Washington, D.C.

[21] Appl. No.: 266,688

[22] Filed: May 22, 1981

[51] Int. Cl.[3] ..... F02B 75/04

[52] U.S. Cl. ..... 123/78 E; 123/197 R

[58] Field of Search ..... 123/78 E, 78 F, 78 R, 123/197 R, 197 AB, 197 AC

[56] References Cited

U.S. PATENT DOCUMENTS

| | | | |
|---|---|---|---|
| 2,060,221 | 11/1936 | King | 123/78 F |
| 4,140,091 | 2/1979 | Showers, Jr. | 123/78 E |
| 4,173,202 | 11/1979 | Crise | 123/78 E |
| 4,195,601 | 4/1980 | Crise | 123/78 E |
| 4,319,498 | 3/1982 | McWhorter | 123/197 AC |

*Primary Examiner*—William A. Cuchlinski, Jr.
*Attorney, Agent, or Firm*—Carl O. McClenny; John R. Manning; Marvin F. Matthews

[57] ABSTRACT

Means for controlling the compression pressure in an internal combustion engine having one or more cylinders and subject to widely varying power output requirements. Received between each crank pin (C) and connecting rod (D) is an eccentric sleeve (F) selectively capable of rotation about the crank pin and/or inside the rod and for latching with the rod (D) to vary the effective length of the connecting rod and thereby the clearance volume of the engine. The eccentric normally rotates inside the connecting rod during the exhaust and intake strokes but a latching pawl (F) carried by the eccentric is movable radially outwardly to latch the rod and eccentric together during the compression and power strokes. A control valve (J) responds to intake manifold pressure to time the supply of hydraulic fluid to move the latch-pawl outwardly, varying the effective rod length to maintain a substantially optimum firing chamber pressure at all intake manifold pressures.

20 Claims, 7 Drawing Figures

AUTOMATIC COMPRESSION ADJUSTING MECHANISM FOR INTERNAL COMBUSTION ENGINES

DESCRIPTION

The invention described herein was made by an employee of the U.S. Government and may be manufactured and used by or for the Government of the United States of America for governmental purposes without the payment of any royalties thereon or therefor.

1. Technical Field

The invention relates to internal combustion engines of the reciprocating piston, spark ignition type, and comprises a novel mechanism for automatically adjusting the compression ratio so as to provide optimum pressure in the firing chamber at the instant of firing, and therefore maximum efficiency.

2. The Prior Art

The firing chamber pressures in variable power internal combustion engines vary widely, resulting in inefficient fuel usage, particularly at lower power. Mechanisms are known which utilize eccentrics rotatably mounted about the crank pin or rod journal of reciprocating piston engines to vary the compression ratio. Examples are U.S. Pat. Nos. 3,180,178 to Brown et al and No. 2,060,221 to King, both adjusting the eccentric manually. However, neither of these nor any other prior art known to applicant utilizes a mechanism for automatically maintaining substantially constant combustion pressure in the combustion spaces of internal combustion engines at all power settings while allowing a shift back to the minimum clearance condition for all exhaust expulsion cycles.

THE PRESENT INVENTION

In accordance with the present invention, an eccentric, interposed between the crank pin and the connecting rod of an internal combustion engine, carries a latching pawl normally within the confines of the eccentric and movable outwardly to latch together the rod and the eccentric in various angular positions. The angular point of latching is determined by a control valve and means sensing pressures in the engine intake manifold. The effective connecting rod length is varied to increase or decrease the volume of the engine firing chamber to maintain the compression pressure essentially constant in each engine compression cycle. Thereafter, the eccentric is released for normal operation, rotating freely inside the connecting rod on exhaust and intake strokes, until the sensor again signals the need for a clearance adjustment requiring appropriate adjustment of the connecting rod length.

BRIEF DESCRIPTION OF THE DRAWINGS

In the accompanying drawings.

DETAILED DESCRIPTION OF THE DRAWINGS

Figure 1:
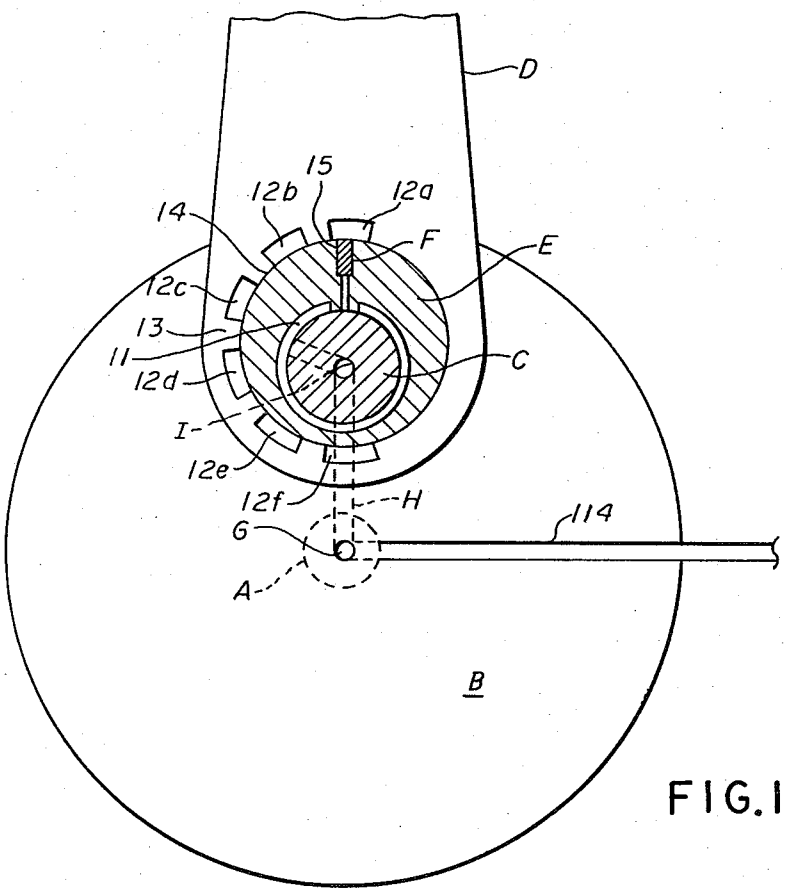
FIG. 1 is a schematic representation of portions of an engine crankshaft and connecting rod with intervening eccentric.

FIG. 1 shows schematically a main journal portion A of an engine crankshaft having one or more cranks B each with a crank pin C, and a portion D of a connecting rod. A portion 13 of the rod bearing shell has a partial circumferential groove therein forming with inwardly projecting lugs 14, to be described later, a series of pockets 12*a*–12*f*.

Figure 4:
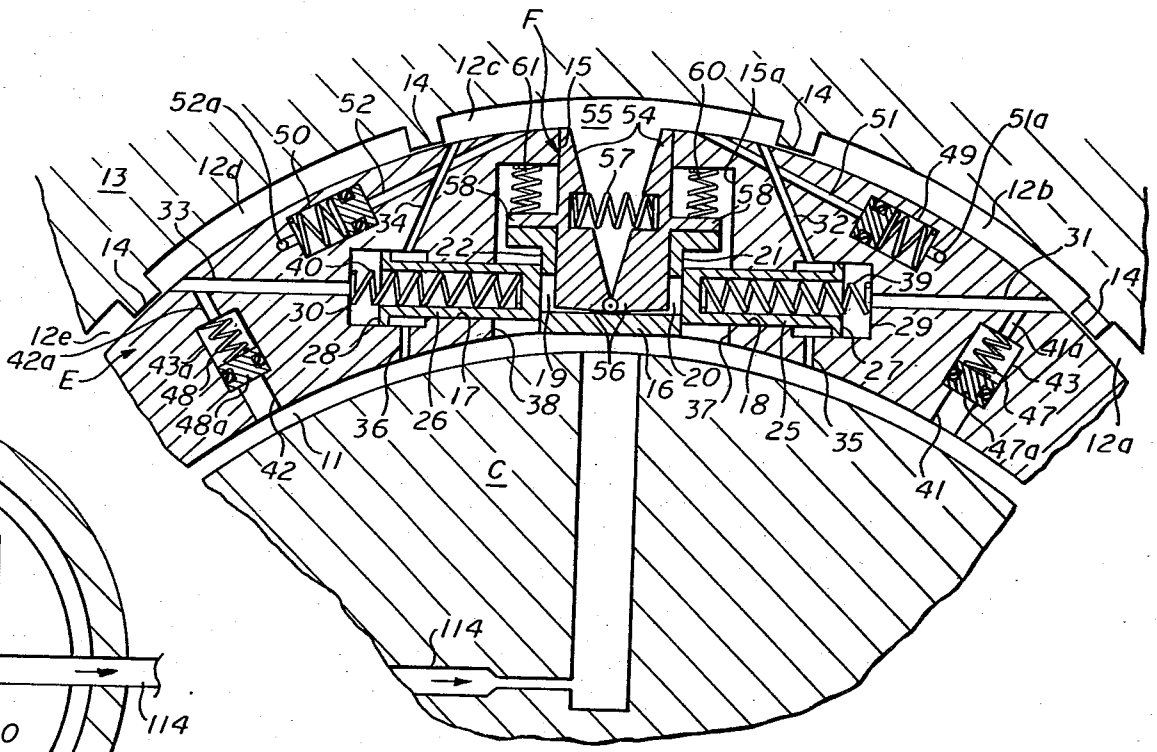
FIG. 4 is another schematic view showing the eccentric and associated parts.

Rotatably received between the crank pin C and rod bearing shell 13 (FIGS. 1 and 4) is an eccentric sleeve E having the pawl-latch F and hydraulic control ducts incorporated therein (FIG. 4). An oil supply passage G extends along the crankshaft and feeds oil ducts H and I in the crank B and crank pin C (FIG. 1). A circumferential groove 11 is provided in the inner concave face of the eccentric E.

Pawl-latch F (to be described hereafter) is radially slidable in a chamber 15 located centrally in the heavy part of the eccentric E. Chamber 15 is open at the top to grooves 12*a*–*f* and closed at the bottom by a plate 16 (FIG. 4). A pair of aligned bores 17 and 18 extend at right angles from the lower part of chamber 15 and communicate therewith through restricted ports 19 and 20 encompassed by valve seat forming shoulders 21 and 22 and plate 16. Slidable in bores 17 and 18 are hollow trigger plungers 25 and 26.

The outer shouldered ends 27 and 28 of these plungers (FIG. 4) are, respectively, received in chambers 29 and 30 connected to oil grooves 12*a*–*f* by ducts 31 and 32 and 33 and 34. Chambers 29 and 30 also connect with groove 11 through trigger passages 35 and 36. The trigger plunger bores (cylinders) 17 and 18 terminate inwardly in plunger encompassing passages 37 and 38 which connect restricted passages 19 and 20 with oil groove 11. Plungers 25 and 26, respectively, are urged inwardly by coiled springs 39 and 40 so as to seat, normally, on shoulders 21 and 22 to close communication between pawl-latch chamber 15 and oil groove 11. Oil groove 11 is also connected by radial ducts 41 and 42 with the intersections of outer oil groove 12*a*–*f* and passages 31 and 33. Ducts 41 and 42 include accumulator chambers 43 and 44, springs 47 and 48, and plungers 47*a* and 48*a*. These accumulators are vented to grooves 12*a*–*f* through passages 41*a* and 42*a*. Additional accumulators 49 and 50 connect with grooves 12*a*–*f* through passages 51 and 52 and are vented at 51*a* and 52*d* to the oil reservoir.

Pawl-latch F consists of two triangular wings 54 pivotally connected at their lower, inner corners 56 and urged apart by a coiled spring 57 to form a chamber 55 therebetween open to grooves 12*a*–*f*. A pair of lateral lugs 58 projecting oppositely from the wings into the enlarged upper portion 15*a* of chamber 15, are urged downwardly by coiled springs 60 and 61. Springs 57, 60, and 61 cause the pawl-latch wings to snugly but slidably engage the portions of chamber 15 above and below the enlarged chamber portion 15*a* and normally to rest on bottom chamber plate 16. Sufficient clearance is provided between plate 16 and wings 54 for application of hydraulic pressure from groove 11 and passages 37 and 38 to the bottom of the pawl-latch for lifting the latter into latching engagement with the connecting rod, as will be described.

The Control Valve

Figure 5:
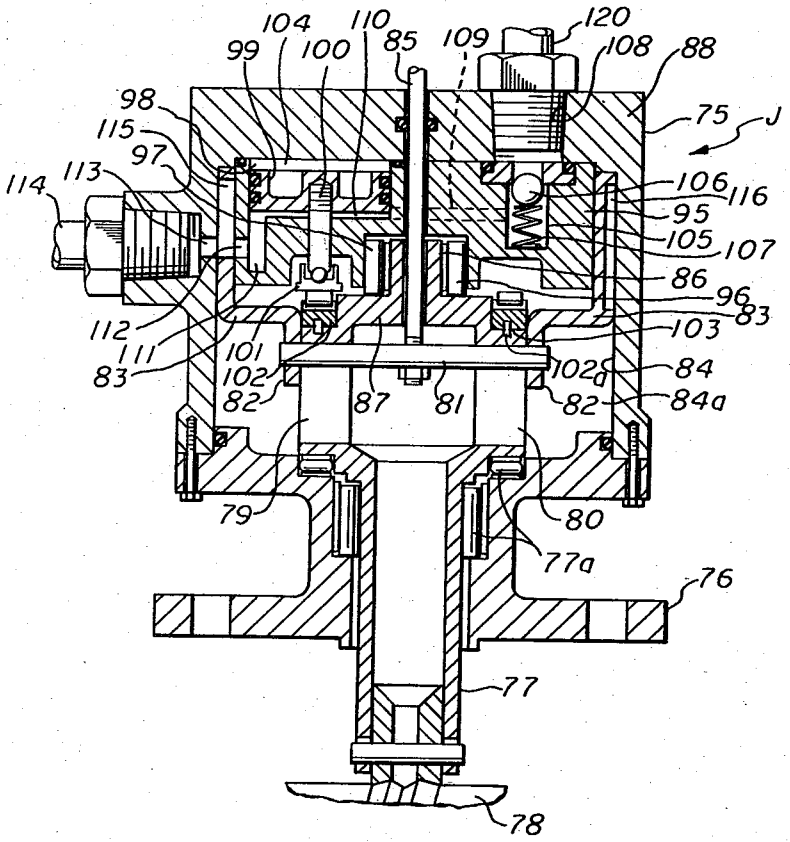
FIG. 5 is a vertical transverse central section of the control valve.

FIG. 5 is a detail view in cross section of the control valve assembly generally designated J. The valve housing 75 is supported on the base 76 in position for convenient access by the hollow rotor actuating shaft 77 to the engine cam shaft 78. The shaft bearings 77*a* provide for venting oil from chamber 84*a* at the bottom of casing 75 as will be explained. At its upper end the shaft is enlarged at 79 and longitudinally slotted at 80 to receive the cross bar 81 terminally secured to depending lugs 82 on the rotor 83. The rotor 23 is cup shaped with its side walls slidable along and inside the housing inner wall 84. A central vertical rod 85 is attached to its lower end to cross bar 81 and slidably extends upwardly through a guide boss 86 on the top wall 87 of shaft enlargement 79 and passes slidably and sealingly through the housing top wall 88. Shaft enlargement 79 and cross pin 81 are located in a chamber 84*a* in the lower part of housing 75. Rod 85 is secured at its upper end to a diaphragm 89 (FIG. 2) in housing 89*a* sensing pressures in intake pipe or manifold 90 to vertically shift the rotor 83 within the housing 75, as will be explained.

Figure 3:
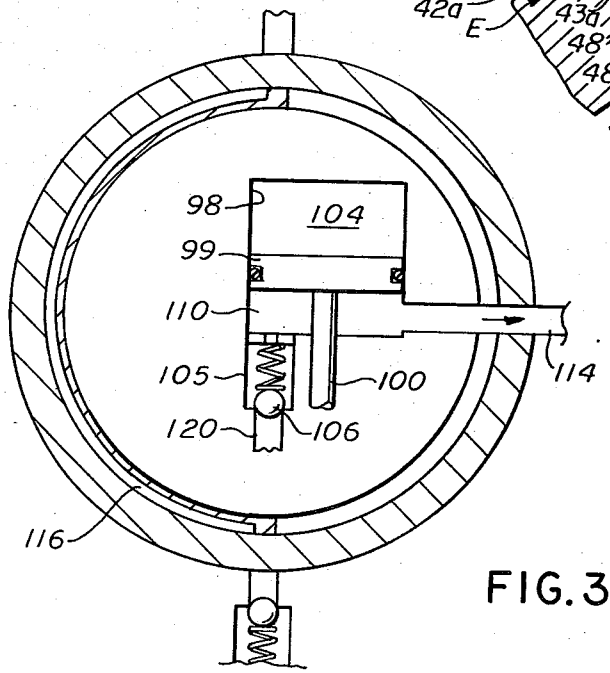
FIG. 3 is a schematic representation of a portion of the hydraulic circuitry for the eccentric control means, including a transverse section through the rotor.

A cylinder body 95 is secured to housing top wall 88 and is lodged within and slidably engages the inner wall of rotor 83. Boss 86 on shaft enlargement 79 rotates within bearings 96, 97 in stationary body 95. A cylinder 98 (FIGS. 3 and 5) formed in the upper portion of body 95 receives a piston 99 having a central depending stem 100 extending slidably through the body. Stem 100 has a cam follower 101 at its lower end bearing against a cam ring 102 secured by pins 102*a* in the circular groove 103 in shaft top wall 87. The cam ring slopes between relatively thick and thinner parts 180° apart so as to periodically lift piston 99. A charge of compressed gas maintained in the chamber 104 above piston 99, cooperates with the cam ring for reciprocating the piston.

Diametrically opposite cylinder 98 on body 95, there is a valve passage 105 containing an intake check valve 106 and valve spring 107 between intake fitting passage 108 and a bore 109 leading to the space 110 beneath piston 99.

Figure 6:
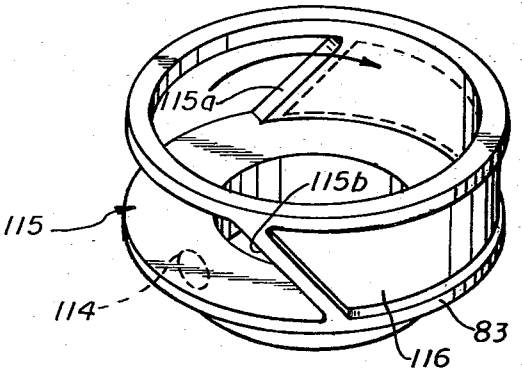
FIG. 6 is an enlarged isometric side view showing the control valve rotor.
Figure 7:
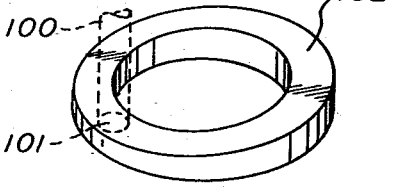
FIG. 7 is an enlarged isometric detail showing the cam and follower.

The downward movement of piston 99 for discharge from space 110 occurs when slipper-follower 101 moves toward a low point on cam 102 under the influence of the gaseous charge in chamber 104 above the piston. High pressure oil is discharged from space 110 through space 111 in the cylinder body, then through window 115 in rotor 83 (FIG. 6) and through passage 113 and out into tubing 114 to be delivered to passages G, H, and I of the crankshaft, crank, and crank pin (FIG. 1).

Figure 2:
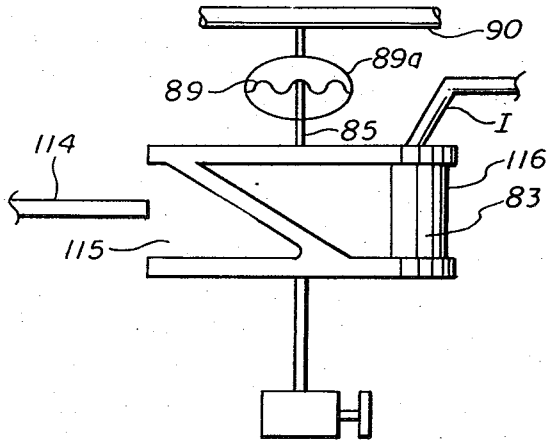
FIG. 2 is a similar representation of actuating means for the eccentric including the control valve rotor.

Window 115, extending approximately 180° around the rotor 83 of the control valve J, is generally parallelogram shaped with control edges 115*a* and 115*b* at its ends. The outer wall of the rotor, between the ends of window 115, is relieved to form a similarly shaped clearance portion 116. The window control edges cross port 112 at some point in rotation, of the rotor 83, as determined by intake manifold pressure sensing diaphragm 89 (FIG. 2). As previously stated, the diaphragm is mechanically connected to cross bar 81 (FIG. 5) secured to rotor 83 so as to raise and lower the rotor 83 in proportion to the pressure in engine air intake manifold 90. This serves to vary the timing of opening of the oil supply line 114 at window 115 for selectively actuating the latching pawl F and venting line 114, etc., through clearance 116, as will be described. Cam 102 is positioned to raise the piston 99 to its maximum height at about 45° of rotation before the window 115 gets in alignment with the ports 112 and 113. Thus the pressure of the gas in chamber 104 is applied to the hydraulic fluid in cavity 110, ready to be released as ports 112, 113 are opened by window 115.

Operation

During the operation of a four stroke cycle engine, with the invention applied thereto, rotation of control valve cam 102 (FIG. 5) with rotor 83, at half crankshaft speed, will alternately lift and lower piston 99 at every two strokes of the engine piston. In other words, piston 99 can move downward during the compression and power strokes and the cam moves it upward during the exhaust and intake strokes. At about 45° before the end of the intake stroke, piston 99 is always returned to its upward position.

At the same time, window 115 will alternately open to initiate and close to stop the supply of oil to piping 114 and to the eccentric for propelling latching pawl F into the registering one of the connecting rod pockets 12*a*–12*f* for latching together the eccentric and rod. After closing the window to port 112, the clearance 116 vents cavity 111 and line 114 to the base chamber 84*a*, allowing the oil to be returned to the engine past shaft bearings 77*a*. As the pawl is released, the inertia of the eccentric will cause it to rotate inside the rod at crankshaft speed until the latch pawl is again activated.

Latching of the eccentric to the connecting rod at the bottom of the stroke results in an effectively reduced rod length with large clearance volume at top dead center, allowing high manifold pressure and a relatively large flow through the engine without excessive compression pressure. On the other hand, latching at the top of the stroke, as in FIG. 1, results in an effectively long connecting rod and a smaller clearance volume in the firing chamber, requiring lower manifold pressure and relatively small flow through the engine. This smaller volume is expanded through the entire displacement range resulting in good energy extraction from the combustion products—thus high efficiency. Operation of the engine at part throttle, which is normally inefficient because of low firing chamber pressures and low expansion ratio of the combustion gases, can be substantially improved by the invention. Likewise operation at full throttle and slow speed is frequently inefficient and marked by detonation because of excessive intake and firing chamber pressures and can be improved by latching the pawl near the bottom of the stroke. The point of latching of the eccentric to the connecting rod is determined by intake pipe pressure through vertical positioning of rotor 83 with window 115 which determines the point in the compression stroke when oil is supplied to project the pawl and latching occurs and, therefore, the regulation of firing chamber volume and the provision for maximum efficent compression pressure and expansion of the combustion gas.

Hydraulic Action

The hydraulic action to control the latching pawl F is as follows: Pressured oil is supplied through piping 120, as from the engine lubricating system, to the control valve and through piping 114 to groove 11 (FIG. 4), trigger passages 35 and 36, and accumulators 43 and 43*a*. When the pressures in chambers 35 and 36 rise sufficiently filling accumulators 43, 43*a*, plungers 25 and 26 are shifted outwardly withdrawing their inner ends from seat forming shoulders 21 and 22 to open restricted ports 19 and 20 and to admit oil to pawl chamber 5. The pressure rise in trigger ducts 35 and 36 is delayed by relief flow through ducts 32 and 34 until the opening of the outer ends of ducts 32 and 34 are covered by lugs 14. This insures that the pressure rise always begins when pawl F is centered between the lugs 14, providing time for full engagement of the pawl before the lug moves into contact with it. The accumulators 43 and 44 must be full and passages 32 and 34 covered before the pressure will rise sufficiently to move pawl F. Thereupon, pawl F quickly moves outwardly into one of the latch pockets 12*a*–12*f* in register therewith at the moment, latching together the eccentric and connecting rod. As explained, this has the effect of varying the clearance volume to compensate for deficient (or excessive) pressure in the engine manifold.

The spacing of lugs 14 in outer groove 12 is sufficiently wide to permit complete travel of the latching elements before contact is made. Flow from accumulators 43 and 44 assists in the oil flow to shift the pawl F into the latching position. During pawl movement, oil displaced from the latch pocket moves into venting accumulators 49 and 50, connected to outer groove 12, which have weaker springs than accumulators 43 and 44.

As the pawl strikes one of the lugs 14, one of the pawl wings 54 folds about pivot 56, displacing oil into the pocket and the adjacent accumulators 49 and 50. The resultant high pressure between the pawl wings acts as a dash pot for controlled deceleration of the eccentric (from crankshaft angular velocity down to rod angular velocity). The latching continues until compression forces are completed.

As the crank nears 180° of rotation beyond this initial latch position, the control valve vents the pawl actuating oil charge through clearance portion 116 of rotor 83, allowing the pawl to recede by the force of its springs 60, 61, and 57, and the oil pressure of the accumulators 49 and 50. The action of springs 39 and 40 recloses pawl chamber ports 19 and 20. The pawl retracts at essentially 180° crank angle beyond that which existed upon pawl projection as controlled by valve port 115. Connecting rod and piston inertia in addition to combustion gas pressures accelerate the speed of the eccentric back to crankshaft speed. During the exhaust and intake strokes the oil charge in the eccentric is substantially fully discharged, releasing the eccentric, allowing maximum piston stroke as the eccentric rotates freely inside the connecting rod and with the angular velocity of the crank shaft journal.

Optimal operation will require testing to verify the best spring rates and other mechanical details. Preliminary analytical estimates indicate that operation to 4000 r.p.m. is feasible. It will be understood that an eccentric with the pawl-latch and controls (FIG. 4) will be provided for each connected rod. These controls may be placed in the connecting rod instead of the eccentric to reduce the size and complication of the eccentric.

The main advantage of this invention over existing compression ratio adjustment schemes is in the ability of the system to respond quickly to changes in power setting, as reflected by manifold pressure level, to adjust the compression pressure to optimum level. This is significant because it provides the best thermodynamic efficiency at all power settings.

$$\text{Efficiency} = 1 - \frac{1}{\text{compression ratio } (N - 1)}$$

where N is the polytropic expansion exponential for the fuel being used (typically about 1.35). Engines with fixed compression ratios suffer serious efficiency loss at part throttle operation. Also, at idle, pressures become so low that misfiring can occur unless the fuel and air mixture is very "rich." Finally, engines with fixed low compression ratios have a "breathing" problem during exhaust and intake strokes. This reduces the capability of the engine to exhaust and/or pull the fresh charge into the cylinder due to the "springiness" or compressibility of the clearance volume gas. These effects are especially traumatic at high speeds.

This invention allows complete discharge of the exhaust gas before intake is started. It allows the use of maximum displacement on every exhaust and intake stroke, improving the effectiveness of the engine as well as its efficiency. This should prove to be very valuable in application to aircraft engines in which, although they operate steadily with near wide-open throttle, pressures are reduced due to altitude effects. With the compression ratio controlled, as described herein, the compression ratio will steadily increase as the manifold pressure decreases at higher altitudes, providing as much as 50% increased thermodynamic efficiency over that typically achieved today. The potential improvement of automobile engines today is even higher, depending upon the amount of time the engine is operated at part throttle. It will help an overpowered vehicle more than an underpowered one. It will tend to normalize the fuel consumption for vehicles of different engine size and make it more consistent with vehicle energy requirements instead of engine size.

Other pertinent conditions, such as engine speed or throttle position, may be used in combination with or in place of the intake manifold pressure to control the piston stroke.

The invention may be modified in these and other respects as will occur to those skilled in the art, and the exclusive use of all modifications as come within the scope of the appended claims is contemplated.

I claim:

1. The combination with an internal combustion engine having at least one cylinder including a piston and firing chamber, an intake duct into which air is throttled to control engine power level, a connecting rod and a crank pin, of the improvement comprising an eccentric sleeve interposed between said rod and pin, an oil circuit for lubrication, latching means carried by said sleeve and rod, and means reflective of pressures in said oil circuit operatively connected to said latching means for shifting the same into latching relationship with said rod.

2. The combination described in claim 1 in which said reflective means comprises means sensitive to pressure in said intake duct.

3. The combination described in claim 2 in which said reflective means comprises a movable push rod responsive to intake pressure.

4. The combination described in claim 1 in which said latching means comprises a pawl-latch movably carried by said sleeve and pocket means in said rod for receiving said pawl-latch.

5. The combination described in claim 4 in which said connecting rod has a plurality of spaced pockets for selective cooperation with said pawl-latch.

6. The combination described in claim 4 further including a hydraulic system and a control valve for controlling the supply of hydraulic fluid to said pawl-latch and operatively connected to said pressure reflective means.

7. The combination described in claim 6 in which said control valve includes means responsive to engine motion for periodically delivering hydraulic fluid to said pawl-latch.

8. The combination described in claim 7 in which said control valve responds to both said reflective means and said engine motion responsive means.

9. The combination described in claim 8 in which said engine motion responsive means delivers hydraulic fluid to said pawl-latch for projecting the same, during successive compression strokes of said piston, for latching said sleeve and rod, and vents said pawl-latch during successive power strokes to unlatch said sleeve and rod.

10. The combination described in claim 9 in which said intake pressure responsive means adjusts the timing of delivery of hydraulic fluid to said pawl-latch.

11. The combination described in claim 6 in which said control valve is hydraulically operated and further including a circumferential passage between said connecting rod and said eccentric sleeve, a trigger duct connecting said hydraulic system and said control valve, a vent duct connecting said control valve and said circumferential passage, and a series of lugs in said circumferential passage positioned to selectively occlude said vent duct to cause said trigger duct to actuate said control valve and open communication between said hydraulic system and said pawl-latch and drive said latch into said circumferential passage to latch together said rod and sleeve and in the interim to vent said control valve to release said rod and sleeve.

12. The combination described in claim 6 in which said pawl-latch is adapted to traverse a radial path in moving into and out of said latching pockets and comprises a pair of pivoted wing members forming a chamber therebetween communicating with said pockets and chamber whereby at least one of said wing members will be caused to approach the other, as said pawl-latch moves into one of said pockets to express fluid from said chamber into said latter pocket for tending to snub the movement of said pawl-latch in said latter pocket.

13. The combination described in claim 11 further including means normally biasing said pawl-latch to its release position out of said circumferential groove.

14. The combination described in claim 11 further including spring influenced accumulator means connected to said trigger passage for storing hydraulic fluid when said pawl-latch is in its release position to provide assistance in actuating said control valve and said pawl-latch when said vent duct is blocked by one of said lugs.

15. The combination described in claim 11 further including a dash pot device connected to said circumferential passage for cushioning said pawl-latch.

16. The combination with an internal combustion engine of the four stroke cycle type having at least one cylinder, piston, connecting rod, and crank pin, of an eccentric sleeve rotatably interposed between said rod and pin, a pawl-latch movably carried by said sleeve and a plurality of latch pockets in said rod adjacent approximately 180° of said sleeve for selectively receiving said pawl-latch to latch together said rod and sleeve, a hydraulic system, and a control valve including a rotor moving at half engine speed and means actuable with said rotor for timely delivering hydraulic fluid for alternately projecting and retracting said pawl-latch for latching and unlatching said rod and sleeve, a window in said rotor controlling the delivery of hydraulic fluid to said pawl-latch, and a device sensitive to pressure in said intake for adjusting said rotor to vary the timing of delivery of hydraulic fluid through said window to said pawl-latch.

17. The combination described in claim 16 in which said pawl-latch comprises pivoted wing members forming a chamber therebetween communicating with said pockets and further including means to supply hydraulic fluid to said pockets and chamber whereby at least one of said wing members will approach the other as said pawl-latch moves into and along one of said pockets, to express fluid from said chamber into said latter pocket and thereby tend to snub said pawl-latch movement while supplying fluid to said dash pot.

18. The combination described in claim 16 in which said control valve further includes port means communicating with said pawl-latch, said rotor further comprising a recessed portion cooperating with said window in control of said pawl-latch.

19. The combination described in claim 16 further including accumulator means communicating with said latch pockets for expediting return of said pawl-latch from said pockets upon release of latching pressure thereon.

20. The combination described in claim 16 further including spring means resisting movement of said pawl-latch outwardly into latching position and for expediting return of said pawl-latch from latching position upon release of latching pressure thereon.

* * * * *